US005743923A

United States Patent [19]

Davies et al.

[11] Patent Number: 5,743,923

[45] Date of Patent: Apr. 28, 1998

[54] OIL ADDITIVES AND COMPOSITIONS

[75] Inventors: Brian William Davies, Blewbury; Kenneth Lewtas, Wantage; Alessandro Lombardi, Abingdon, all of United Kingdom

[73] Assignee: Exxon Chemical Patents Inc., Linden, N.J.

[21] Appl. No.: 668,202

[22] PCT Filed: Oct. 21, 1993

[86] PCT No.: PCT/EP93/02908

§ 371 Date: Apr. 25, 1995

§ 102(e) Date: Apr. 25, 1995

[87] PCT Pub. No.: WO94/10267

PCT Pub. Date: May 11, 1994

Related U.S. Application Data

[63] Continuation of Ser. No. 424,374, Apr. 25, 1995, abandoned.

[30] Foreign Application Priority Data

Oct. 26, 1992 [GB] United Kingdom ..... 9222458

[51] Int. Cl.[6] ..... C10L 1/18; C10L 1/22

[52] U.S. Cl. ..... 44/393; 44/394; 44/395

[58] Field of Search ..... 44/393, 394, 395

[56] References Cited

U.S. PATENT DOCUMENTS

| | | | |
|---|---|---|---|
| 3,402,223 | 9/1968 | Hollingsworth | 260/897 |
| 3,642,459 | 2/1972 | Ilnyckyj | 44/393 |
| 3,961,916 | 6/1976 | Ilnyckyj et al. | 44/393 |
| 4,211,534 | 7/1980 | Feldman | 44/393 |
| 4,364,743 | 12/1982 | Erner | 44/388 |
| 4,404,000 | 9/1983 | Toyoshima et al. | 44/393 |
| 4,661,121 | 4/1987 | Lewtas | 44/393 |
| 5,554,200 | 9/1996 | Brod et al. | 44/393 |

FOREIGN PATENT DOCUMENTS

| | | |
|---|---|---|
| 0476197 | 3/1992 | European Pat. Off. . |
| 0018115 | 9/1993 | WIPO . |

*Primary Examiner*—Margaret Medley
*Attorney, Agent, or Firm*—John J. Mahon

[57] ABSTRACT

The low temperature properties of a blend of biofuel and petroleum-based fuel oil are improved by the addition of an ethylene-unsaturated ester copolymer, or a comb polymer, or a polar N compound, or a compound having at least one linear alkyl groups connected to a non-polymeric organic residue.

3 Claims, No Drawings

OIL ADDITIVES AND COMPOSITIONS

This is a continuation application Ser. No. 424,374, filed Apr. 25, 1995, now abandoned which is based on PCT/EP93/02908 filed Oct. 21, 1993, which is based on GB 9222458.3 filed Oct. 26, 1992.

This invention relates to oil compositions, primarily to fuel oil compositions, and more especially to fuel oil compositions susceptible to wax formation at low temperatures, and to additive compositions for such fuel oil compositions.

Fuel oils, whether derived from petroleum or from vegetable sources, contain components that at low temperature tend to precipitate as large crystals of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an alkane wax, crystallizes as platelets; certain additives inhibit this, causing the wax to adopt an acicular habit, the resulting needles being more likely to pass through a filter than are platelets. The additives may also have the effect of retaining in suspension in the fuel the crystals that have formed, the resulting reduced settling also assisting in prevention of blockages.

Fuels from vegetable sources, also known as biofuels, are believed to be less damaging to the environment on combustion, and are obtained from a renewable resource. It has been reported that on combustion less carbon dioxide is formed than is formed by the equivalent quantity of petroleum distillate fuel, e.g., diesel fuel, and very little sulphur dioxide is formed. Certain derivatives of vegetable oil, for example rapeseed oil, e.g., those obtained by saponification and re-esterification with a monohydric alcohol, may be used as a substitute for diesel fuel. It has recently been reported that mixtures of a rapeseed ester, for example, rapeseed methyl ester (RME), with petroleum distillate fuels in ratios of, for example, 10:90 by volume are likely to be commercially available in the near future.

However, such mixtures may have poorer low temperature flow properties than the individual components themselves. A measure of the flowability of fuels at low temperature is the cold filter plugging point (CFPP) test, described in "Journal of the Institute of Petroleum" 52(1966), 173 to 185. In one case, described in more detail below, a mixture of equal volumes of a diesel fuel with a CFPP of −6° C. and an RME with a CFPP of −13° C. had a CFPP of only −5° C., while a 90:10 diesel:RME mixture had a CFPP of −4° C., both higher than the CFPP of either fuel alone.

A further problem encountered at temperatures low enough for wax to form in a fuel is the settlement of the wax to the lower region of any storage vessel. This has two effects: one in the vessel itself where the settled layer of wax may block an outlet at the lower end, and the second in subsequent use of the fuel. The composition of the wax-rich portion of fuel will differ from that of the remainder, and will have poorer low temperature properties than that of the homogeneous fuel from which it is derived.

There are various additives available which change the nature of the wax formed, so that it remains suspended in the fuel, achieving a dispersion of waxy material throughout the depth of the fuel in the vessel, with a greater or lesser degree of uniformity depending on the effectiveness of the additive on the fuel.

Although the way in which CFPP depressants and wax anti-settling additives function is not completely understood, there is evidence that their effectiveness depends to a significant extent on matching of the alkanes in the fuel to alkyl or alkylene chains in the additive, the growth of the alkane wax crystals being affected, for example, by the co-crystallization of an alkyl chain of similar length in an additive.

Whereas the aliphatic middle distillate fuels contain largely alkanes, however, the aliphatic moieties of biofuels contain a high proportion of unsaturated chains. For example, rapeseed oil typically contains the esters of, in addition to some 11 to 19% $C_{16}$ to $C_{18}$ saturated acids, some 23 to 32% mono-, 40 to 50% di- and 4 to 12 triunsaturated $C_{18}$ to $C_{22}$ acids, primarily oleic, linoleic, linolenic, and erucic acids. These do not crystallize in the same way as do the saturated materials, and it would therefore not be expected that the additives suitable for improving low temperature properties of petroleum-based fuels would be effective in biofuels, and that their effectiveness in mixtures of biofuels and petroleum-based fuels would be limited in accordance with the proportion of petroleum fuel in the mixture.

It has surprisingly been found, however, that certain cold flow additives have a beneficial effect on low temperature properties of a biofuel-petroleum fuel mixture greater than in the petroleum fuel alone.

The present invention provides a fuel oil composition comprising a biofuel, a petroleum-based fuel oil, and an additive comprising at least one petroleum fuel oil wax crystal modifier or pour point depressant or both, comprising (a) an oil-soluble copolymer of ethylene or (b) a comb polymer or, (c) a polar nitrogen compound, or (d) a compound in which at least one substantially linear alkyl group having 10 to 30 carbon atoms is connected to a non-polymeric organic residue to provide at least one linear chain of atoms that includes the carbon atoms of said alkyl groups and one or more non-terminal oxygen atoms, or (e) one or more of components (a), (b), (c) and (d).

As biofuel, or fuel derived from a vegetable source, especially an agricultural product, there may be used, for example, a liquid fuel, especially an oil. A preferred oil is a vegetable oil, for example soya, palm, sunflower, cottonseed, peanut, coconut or rapeseed oil, either as such or, preferably, saponified and esterified (or transesterified), preferably with a monohydric alcohol, especially methanol. The presently preferred biofuel is rapeseed methyl ester.

The petroleum-based fuel oil may be a distillate, especially a middle distillate, petroleum fraction. Such distillate fuel oils generally boil within the range of from 100° C. to 500° C., e.g. 150° to 400° C. The fuel oil may comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or it may contain vacuum gas oil or cracked components or both.

The invention is applicable to mixtures of the fuels in all proportions; more especially, however, the composition comprises from 5 to 75%, more especially 10 to 50%, of biofuel. It is within the scope of the invention to use two or more petroleum-based fuels or, more especially, two or more biofuels, in admixture with one or more of the other type of fuel.

Preferably, the mixture of the fuels of this invention contains less than 5% by volume of methanol, for example 4%, 3%, 2% or 1% or substantially no methanol.

The components of the additive will now be discussed in further detail as follows. It should be noted that individual polymers or compounds may fall within more than one of the definitions of (a), (b), (c) and (d) herein.

(a) Oil Soluble Copolymers of Ethylene

The oil-soluble copolymer, component (a), may be a copolymer of ethylene with an ethylenically unsaturated ester, such as a copolymer of ethylene with an ester of an unsaturated carboxylic acid and a saturated alcohol, but the ester is preferably one of an unsaturated alcohol with a saturated carboxylic acid. An ethylene-vinyl ester copolymer is advantageous; an ethylene-vinyl acetate, ethylene-vinyl propionate ethyl-vinyl hexanoate, or ethyl-vinyl octanoate copolymer is preferred.

More especially, component (a) may comprise an ethylene copolymer having, in addition to units derived from ethylene, units of the formula $$—CH_2—CRR^{30}— \quad X$$

wherein R represents H or $CH_3$, and $R^{30}$ represents a group of the formula $COOR^3$ or $OOCR^4$, wherein $R^3$ and $R^4$ independently represent a hydrocarbyl group.

As described in U.S. Pat. No. 3,961,916, a composition comprising both a wax growth arrestor and a nucleating agent is an effective low temperature flow improver for middle distillate fuel oils. The arrestor and nucleating agent are preferably a lower molecular weight ethylene-unsaturated ester polymer with a higher ester content, and a higher molecular weight ethylene-unsaturated ester polymer with a lower ester content respectively. Advantageously the ester is vinyl acetate in both copolymers. Such a combination has been found extremely effective in the present invention. More especially, the combination comprises:

(i) an oil-soluble ethylene copolymer having, in addition to units derived from ethylene, from 7.5 to 35 molar percent of units of the formula $$—CH_2—CRR^1— \quad I$$

and (ii) an oil-soluble ethylene copolymer having, in addition to units derived from ethylene, up to 10 molar percent of units of the formula $$—CH_2—CRR^2— \quad II$$

wherein each R independently represents H or $CH_3$, and each $R^1$, and $R^2$ independently represents a group of the formula $COOR^3$ or $OOCR^4$, wherein $R^3$ and $R^4$ independently represent a hydrocarbyl group, the proportion of units I in polymer (i) being at least 2 molar percent greater than the proportion of units II in polymer (ii).

As used in this specification the term "hydrocarbyl" refers to a group having a carbon atom directly attached to the rest of the molecule and having a hydrocarbon or predominantly hydrocarbon character. Among these, there may be mentioned hydrocarbon groups, including aliphatic, (e.g., alkyl or alkenyl), alicyclic (e.g., cycloalkyl or cycloalkenyl), aromatic, aliphatic and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred. Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulphur, and, preferably, oxygen. Advantageously, the hydrocarbyl group contains at most 30, preferably at most 15, more preferably at most 10 and most preferably at most 8, carbon atoms.

In respect of formulae X, I and II above, advantageously, R represents H and advantageously, $R^3$ and $R^4$ each independently represents an alkenyl or as indicated above, preferably, an alkyl group, which is advantageously linear. If the alkyl or alkenyl group is branched, for example, as in the 2-ethylhexyl group, the alpha-carbon atom is advantageously part of a methylene group. Advantageously, the alkyl or alkenyl group contains up to 30 carbon atoms, preferably from 1 (2 in the case of alkenyl) to 14 carbon atoms, and more preferably from 1 to 10 carbon atoms. As examples of alkyl or alkenyl groups there may be mentioned methyl, ethyl, propyl, n-butyl, iso-butyl, and isomers, preferably the linear isomers, of pentyl, hexyl, heptyl, octyl, nonyl, decyl, undecyl, dodecyl, tridecyl, tetradecyl, pentadecyl, hexadecyl, heptadecyl, octadecyl, nonadecyl and icosyl, and their corresponding alkenyl, advantageously alk-omega-enyl, radicals.

As cycloalkyl, alkaryl and aryl radicals, there may be mentioned, for example, cyclohexyl, benzyl and phenyl.

The copolymer or copolymers may also contain units of formulae other than those mentioned above, for example units of the formula $$—CH_2—CRR^5— \quad III$$

where $R^5$ represents —OH, or of the formula $$—CCH_3(CH_2R^6)—CHR^7— \quad IV$$

where $R^6$ and $R^7$ each independently represent hydrogen or an alkyl group with up to 6 carbon atoms, the units IV advantageously being derived from isobutylene, diisobutylene, 2-methylbut-2-ene or 2-methylpent-2-ene.

Units of the formula X, I or II or may be terminal units but are advantageously internal units. Advantageously, units of the formula I represent from 10 to 25, preferably from 10 to 20, and more preferably from 11 to 16, mole percent of the polymer (i). Advantageously, units of the formula II represent up to 7.5, preferably from 0.3 to 7.5, and more preferably from 3.5 to 7.0, mole percent of the polymer (ii).

In the copolymer having units of the formula X as defined above, units of the formula X preferably represent from 5 to 40 mole percent of the copolymer, more preferably from 7.5 to 35 mole percent, most preferably 7.5 to 25 mole percent. Such copolymer advantageously has a number average molecular weight, as measured by gel permeation chromatography, of at most 14,000, preferably 2,000 to 5,500, and most preferably 3,000 to 4,000.

The copolymer (i) advantageously has a number average molecular weight, as measured by gel permeation chromatography, of at most 14,000, advantageously at most 10,000, more advantageously in the range of 1,400 to 7,000, preferably 2,000 to 5,500 and most preferably about 4,000. For the polymer (ii) the number average molecular weight is advantageously at most 20,000, preferably up to 15,000 and more preferably from 1,200 to 10,000, and most preferably from 3,000 to 10,000. The preferred number average molecular weight will depend to some extent on the number of carbon atoms in $R^3$ and $R^4$, the higher that number the higher the preferred molecular weight within the range above. Advantageously, the number average molecular weight of the polymer (ii) is greater, by at least 500, and preferably at least 1,000, than that of polymer (i).

Polymers in which $R^1$ or $R^2$ represents $OOCR^4$ are preferred and more preferably both $R^1$ and $R^2$ both represent $OOCR^4$.

Polymers containing units I and units II are advantageously present in a weight ratio of from 10:1 to 1:10, preferably from 10:1 to 1:3, and more preferably from 7:1 to 1:1.

It is within the scope of the invention to use two or more polymers (i) and/or two or more polymers (ii) in the same additive composition. It is also within the scope of the invention to employ a polymer (i) or (ii) having two or more different units of types I and II. Units I in polymer (i) may be the same as or different from units II in polymer (ii).

The oil-soluble copolymer of ethylene may also comprise a copolymer of ethylene and at least one α-olefin, having a number average molecular weight of at least 30,000. Preferably the α-olefin has at most 20 carbon atoms. Examples of such olefins are propylene, 1-butene, isobutene, n-octene-1, isooctene-1, n-decene-1, and n-dodecene-1. The copolymer may also comprise small amounts, e.g., up to 10% by weight, of other copolymerizable monomers, for example olefins other than α-olefins, and non-conjugated dienes. The preferred copolymer is an ethylene-propylene copolymer. It is within the scope of the invention to include two or more different ethylene-α-olefin copolymers of this type.

The number average molecular weight of the ethylene-α-olefin copolymer is, as indicated above, at least 30,000, as measured by gel permeation chromatography (GPC) relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 percent. More advantageously, the ethylene content is within the range of from 57 to 80%, and preferably it is in the range from 58 to 73%; more preferably from 62 to 71%, and most preferably 65 to 70%.

Preferred ethylene-α-olefin copolymers are ethylene-propylene copolymers with a molar ethylene content of from 62 to 71% and a number average molecular weight in the range 60,000 to 120,000, especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially amorphous, since highly crystalline polymers are relatively insoluble in fuel oil at low temperatures.

The composition may also comprise a further ethylene-α-olefin copolymer, advantageously with a number average molecular weight of at most 7500, advantageously from 1,000 to 6,000, and preferably from 2,000 to 5,000, as measured by vapour phase osmometry. Appropriate α-olefins are as given above, or styrene, with propylene again being preferred. Advantageously the ethylene content is from 60 to 77 molar percent although for ethylene-propylene copolymers up to 86 molar percent by weight ethylene may be employed with advantage.

The copolymer should preferably be soluble in the oil to the extent of at least 1000 ppm by weight per weight of oil at ambient temperature. However, at least some of the copolymer may come out of solution near the cloud point of the oil and function to modify the wax crystals that form.

The composition advantageously contains the ethylene copolymer, or coplymer combination, in a total proportion of 0.0005% to 1%, advantageously 0.001 to 0.5%, and preferably 0.01 to 0.15% by weight, based on the weight of fuel.

(b) Comb Polymers

Component (b) is a comb polymer. Such polymers are discussed in "Comb-Like Polymers. Structure and Properties", N. A. Platé and V. P. Shibaev, J. Poly. Sci. Macromolecular Revs., 8, p 117 to 253 (1974).

Generally, comb polymers have one or more long chain branches such as hydrocarbyl branches having from 10 to 30 carbon atoms, pendant from a polymer backbone, said branch or branches being bonded directly or indirectly to the backbone. Examples of indirect bonding include bonding via interposed atoms or groups, which bonding can include covalent and/or electrovalent bonding such as in a salt.

Advantageously, the comb polymer is a homopolymer having, or a copolymer at least 25 and preferably at least 40, more preferably at least 50, molar percent of the units of which have, side chains containing at least 6, and preferably at least 10, atoms, selected from for example carbon, nitrogen and oxygen, in a linear chain.

As examples of preferred comb polymers there may be mentioned those containing units of the general formula

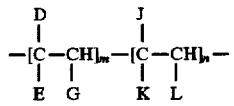

wherein

D=$R^{11}$, $COOR^{11}$, $OCOR^{11}$, $R^{12}COOR^{11}$, or $OR^{11}$,

E=H, $CH_3$, D, or $R^{12}$,

G=H or D

J=H, $R^{12}$, $R^{12}COOR^{11}$, or an aryl or heterocyclic group,

K=H, $COOR^{12}$, $OCOR^{12}$, $OR^{12}$, or COOH,

L=H, $R^{12}$, $COOR^{12}$, $OCOR^{12}$, COOH, or aryl, $R^{11} \geqq C_{10}$ hydrocarbyl, $R^{12} \geqq C_1$ hydrocarbyl, and m and n represent mole ratios, m being within the range of from 1.0 to 0.4, n being in the range of from 0 to 0.6. $R^{11}$ advantageously represents a hydrocarbyl group with from 10 to 30 carbon atoms, while $R^{12}$ advantageously represents a hydrocarbyl group with from 1 to 30 carbon atoms.

The comb polymer may contain units derived from other monomers if desired or required. It is within the scope of the invention to include two or more different comb polymers.

The molecular weight of the comb polymer is not critical. Advantageously, however, it is within the range of from 1,000 to 100,000, preferably between 1,000 and 30,000, as measured by vapour phase osmometry.

These comb polymers may be copolymers of maleic anhydride or fumaric acid and another ethylenically unsaturated monomer, e.g., an alpha-olefin or an unsaturated ester, for example, vinyl acetate. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, 1-tetradecene, 1-hexadecene, and 1-octadecene.

The copolymer may be derivatized, e.g., esterified, by any suitable technique, e.g., by reaction with alcohols, primary or secondary amines, or amino-alcohols, and although preferred it is not essential that the maleic anhydride or fumaric acid be at least 50% derivatized. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol, 2-methyltridecan-1-ol. The alcohol may be a mixture of normal and single methyl branched alcohols. It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or itaconate polymers and copolymers such for example as those described in EP-A-153176, -153177, -155807, -156577 and -225688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 12 carbon atoms or in which the alkyl groups are a mixture of $C_{12}/C_{14}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{12}$ and $C_{14}$ alcohols. Furthermore, mixtures of the $C_{12}$ ester with the mixed $C_{12}/C_{14}$ ester may advantageously be used. In such mixtures, the ratio of $C_{12}$ to $C_{12}/C_{14}$ is advantageously in the range of from 1:1 to 4:1, preferably 2:1 to 7:2, and most preferably about 3:1, by weight.

Other suitable comb polymers are the polymers and copolymers of α-olefins and esterified copolymers of styrene and maleic anhydride, and esterified copolymers of styrene and fumaric acid; mixtures of two or more comb polymers may be used in accordance with the invention and, as indicated above, such use may be advantageous.

The composition advantageously contains the comb polymer in a proportion of 0.0005 to 1, preferably from 0.001 to 0.5, and most preferably from 0.01 to 0.15, percent by weight based on the weight of the fuel.

(c) Polar Nitrogen Compounds

For example, there may be used one or more of the compounds (i) to (iii) as follows:

(i) An amine salt and/or amide obtainable by treating at least one molar proportion of a hydrocarbyl amine with a molar proportion of a hydrocarbyl mono- or poly-carboxylic acid, e.g., having 1 to 4 carboxylic acid groups, or with an anhydride of such an acid.

Ester/amides may be used containing from 30 to 300, preferably 50 to 150 total carbon atoms. These nitrogen compounds are described in U.S. Pat. No. 4,211,534. Suitable amines are usually long chain $C_{12}$ to $C_{40}$ primary, secondary, tertiary or quaternary amines or mixtures thereof but shorter chain amines may be used provided the resulting nitrogen compound is oil soluble and accordingly normally contains from 30 to 300 total carbon atoms. The nitrogen compound preferably contains at least one straight chain $C_8$ to $C_{40}$, preferably $C_{14}$ to $C_{24}$, alkyl segment.

Suitable amines include primary, secondary, tertiary or quaternary, but preferably are secondary. Tertiary and quaternary amines form only amine salts. Examples of amines include tetradecyl amine, cocoamine, and hydrogenated tallow amine. Examples of secondary amides include dioctadecyl amine and methyl-behenyl amine.

Amine mixtures are also suitable, for example, those derived from natural materials. A preferred secondary amine is di(hydrogenated tallow) amine having alkyl groups derived from hydrogenated tallow fat composed of approximately 4% $C_{14}$, 31% $C_{16}$ and 59% $C_{18}$ radicals.

Examples of suitable carboxylic acids and their anhydrides for preparing the nitrogen compounds include cyclohexane-1,2-dicarboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactone. Generally, these acids have from 5 to 13 carbon atoms in the cyclic moiety. Preferred acids are benzene dicarboxylic acids such as phthalic acid, isophthalic acid, and terephthalic acid. Phthalic acid or its anhydride is particularly preferred.

The preferred compounds are an amide-amine salt of phthalic anhydride with two molar proportions of hydrogenated tallow amine, the diamide product obtainable by dehydrating this salt, and the amide-amine salt of orthosulphobenzoic anhydride and hydrogenated tallow amine.

Other examples are long chain alkyl or alkylene substituted dicarboxylic acid derivatives, for example, amine salts or monoamides of substituted succinic acids, examples of which are described in, for example, U.S. Pat. No. 4,147,520. Suitable amines may be those described above. Further examples are condensates such, for example, as described in EP-A-327,423, EP-A-413,279 and EP-A-398,101.

(ii) A compound comprising or including a ring system, the compound carrying on the ring system at least two but preferably only two substituents of the general formula $$—A—NR^{21}R^{22}$$

where A is an aliphatic hydrocarbyl group that is optionally interrupted by one or more hetero atoms and that is straight chain or branched, and $R^{21}$ and $R^{22}$ are the same or different and each is independently a hydrocarbyl group containing 9 to 40 carbon atoms optionally interrupted by one or more hetero atoms, the substituents being the same or different and the compound optionally being in the form of a salt thereof, for example the acetate or the hydrochloride.

Preferably, A has from 1 to 20 carbon atoms and is preferably a methylene or polymethylene group.

The cyclic ring system may be a homocyclic, heterocyclic, monocyclic, polycyclic or fused polycyclic assembly, or a system where two or more such cyclic assemblies are joined to one another and in which the cyclic assemblies may be the same or different. Where there are two or more such cyclic assemblies, the defined substituents may be on the same or different assemblies, preferably on the same assembly. Preferably, the or each cyclic assembly is aromatic, more preferably a benzene ring. Most preferably, the cyclic ring system is a single benzene ring, the substituents preferably being in the ortho or meta positions, which benzene ring may be optionally further substituted.

The ring atoms in the cyclic assembly or assemblies are preferably carbon atoms but may for example include one or more ring N, S or O atoms.

Examples of such polycyclic assemblies include:

(a) condensed benzene structures, for example, naphthalene, anthracene, phenanthrene, and pyrene;

(b) condensed ring structures where none of or not all of the rings is or are benzene, for example, azulene, indene, hydroindene, fluorene, and diphenyleneoxide;

(c) rings joined "end-on", for example, diphenyl;

(d) heterocyclic compounds, for example, quinoline, indole, 2,3-dihydroindole, benzofuran, coumarin, isocoumarin, benzothiophene, carbazole and thiodiphenylamine;

(e) non-aromatic or partially saturated ring systems, for example, decalin (decahydronaphthalene), alpha-pinene, cardinene, and bornylene; and (f) multi-ring structures, for example, norbornene, bicycloheptane (norbornane), bicyclooctane, and bicyclooctene.

Each hydrocarbyl group $R^{21}$ and $R^{22}$ may for example be an alkylene or alkylene group or a mono- or polyalkoxyalkyl group. Preferably, each hydrocarbyl group is a linear alkylene group. The number of carbon atoms in each hydrocarbyl group is preferably from 16 to 40, more preferably 16 to 24.

The compounds may conveniently be made by reducing the corresponding amide which may in turn have been made by reaction of a secondary amine and the appropriate acid chloride.

(iii) A condensate of a long chain primary or secondary amine with a carboxylic acid-containing polymer.

Specific examples include polymers such, for example, as described in GB-A-2,121,807, FR-A-2,535,723 and DE-A-3,941,561; and also esters of telomer acid and alkanoloamines such, for example, as described in U.S. Pat. No. 4,639,256; and the reaction product of an amine containing a branched carboxylic acid ester, an epoxide and a monocarboxylic acid polyester such, for example, as described in U.S. Pat. No. 4,631,071.

Compositions comprising at least one comb polymer and/or at least one polar nitrogen compound in addition to an ethylene/ unsaturated ester copolymer have much improved resistance to wax settlement and are preferred.

(d) Compounds as Defined Herein

By "substantially linear" is meant that the alkyl group is preferably straight chain, but that essentially straight chain alkyl groups having a small degree of branching such as in the form of a single methyl group may be used.

Preferably, the compound has at least two of said alkyl groups when the linear chain may include the carbon atoms of more than one of said alkyl groups. When the compound has at least three of said alkyl groups, there may be more than one of such linear chains, which chains may overlap. The linear chain or chains may provide part of a linking group between any two such alkyl groups in the compound.

The oxygen atom or atoms are preferably directly interposed between carbon atoms in the chain and may, for example, be provided in the form of a mono- or polyoxyalkylene group, said oxyalkylene group preferably having 2 to 4 carbon atoms, examples being oxyethylene and oxypropylene.

As indicated the chain or chains include carbon and oxygen atoms. They may also include other hetero-atoms such as nitrogen atoms.

The compound may be an ester where the alkyl groups are connected to the remainder of the compound as —O—CO—n-alkyl, or —CO—O—n-alkyl groups, in the former the alkyl groups being derived from an acid and the remainder of the compound being derived from a polyhydric alcohol and in the latter the alkyl groups being derived from an alcohol and the remainder of the compound being derived from a polycarboxylic acid. Also, the compound may be an ether where the alkyl groups are connected to the remainder of the compound as —O—n-alkyl groups. The compound may be both an ester and an ether or it may contain different ester groups.

Examples include polyoxyalkylene esters, ethers, ester/ethers and mixtures thereof, particularly those containing at least one, preferably at least two, $C_{10}$ to $C_{30}$ linear alkyl groups and a polyoxyalkylene glycol group of molecular weight up to 5,000, preferably 200 to 5,000, the alkylene group in said polyoxyalkylene glycol containing from 1 to 4 carbon atoms, as described in EP-A-61 895 and in U.S. Pat. No. 4,491,455.

The preferred esters, ethers or ester/ethers which may be used may be structurally depicted by the formula $$R^{23}OBOR^{24}$$

where $R^{23}$ and $R^{24}$ are the same or different and may be (a) n-alkyl—

(b) n-alkyl—CO—

(c) n-alkyl—OCO—$(CH_2)_n$—

(d) n-alkyl—OCO—$(CH_2)_n$CO— n being, for example, 1 to 34, the alkyl group being linear and containing from 10 to 30 carbon atoms, and B representing the polyalkylene segment of the glycol in which the alkylene group has from 1 to 4 carbon atoms, for example, polyoxymethylene, polyoxyethylene or polyoxytrimethylene moiety which is substantially linear; some degree of branching with lower alkyl side chains (such as in polyoxypropylene glycol) may be tolerated but it is preferred that the glycol should be substantially linear. B may also contain nitrogen.

Suitable glycols generally are substantially linear polyethylene glycols (PEG) and polypropylene glycols (PPG) having a molecular weight of about 100 to 5,000, preferable about 200 to 2,000. Esters are preferred and fatty acids containing from 10 to 30 carbon atoms are useful for reacting with the glycols to form the ester additives, it being preferred to use a $C_{18}$ to $C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred when the petroleum based component is a narrow boiling distillate, when minor amounts of monoethers and monoesters (which are often formed in the manufacturing process) may also be present. It is important for active performance that a major amount of the dialkyl compound is present. In particular, stearic or behenic diesters of polyethylene gylcol, polypropylene glycol or polyethylene/polypropylene glycol mixtures are preferred.

Examples of other compounds in this general category are those described in Japanese Patent Publication Nos. 2-51477 and 3-34790 and EP-A-117,108 and EP-A-326,356, and cyclic esterified ethoxylates such as described EP-A-356,256.

The composition may contain other additives for improving low temperature and/or other properties, many of which are in use in the art or known from the literature.

The invention also provides an additive concentrate comprising the additive in admixture with a biofuel or with a mixture of a biofuel and a petroleum-based fuel oil. The invention further provides the use of the additive to improve the low temperature properties of a biofuel/petroleum-based fuel mixture.

The following Examples, in which all parts and percentages are by weight, number average molecular weights are measured by vapour phase osmometry, and internal methyl groups in polymers by proton NMR (i.e., excluding terminal methyl groups and those arising from acetate groups), illustrate the invention.

The petroleum-based fuels used in the Examples had the following characteristics.

| | Fuel 1 | Fuel 2 |
|---|---|---|
| Cloud Point, °C. | −3 | −3 |
| CFPP, °C. | −6 | −5 |
| Distillation, °C. ASTM D86 | | |
| IBP | 162 | 168 |
| 20% | 206 | 203 |
| 90% | 332 | 330 |
| FBP | 375 | 371 |
| 90-20 | 126 | 127 |
| FBP-90 | 43 | 41 |

The rapeseed oil methyl ester was produced by extraction from the oilseed by screw pressing, refining, and transesterifying with methanol.

EXAMPLE 1

In this example, the biofuel used was an RME with a cloud point of −4° C., and a CFPP of −11° C., and the petroleum fuel was Fuel 2.

The ethylene-unsaturated ester copolymer was a blend of two ethylene-vinyl acetate copolymers, EVA 1, 36 wt % vinyl acetate, $\overline{M}n$ about 2400, $CH_3/100$ $CH_2$ 4, and EVA 2, 14 wt % vinyl acetate, $\overline{M}n$ about 3500, $CH_3/100$ $CH_2$ 7.

The weight ratio of EVA 1:EVA 2 was 6:1.

The wax antisettling agent was WASA 1, a blend of equal parts by weight of a $C_{12}/C_{14}$ alkyl fumarate/vinyl acetate comb copolymer and the amide-amine salt of phthalic anhydride with two molar proportions of hydrogenated tallow.

320 ppm of the blend of EVA 1 and EVA 2 polymers were mixed with pure RME, pure Fuel 2, and mixtures of RME and Fuel 2, and the CFPP's compared with those of the untreated fuels. The results are shown in Table 1.

TABLE 1

| | CFPP, °C. | |
|---|---|---|
| Fuel | Untreated | Treated |
| RME alone | −11 | −13 |
| RME 50%, Fuel 2 50% | −10 | −27 |
| RME 10%, Fuel 2 90% | −3 | −27 |
| Fuel 2 alone | −4 | −16 |

From these results it can be seen that while the EVA blend was only marginally effective in RME alone, and showed its usual effect on the CFPP of the petroleum fuel, the CFPP's of the treated RME/Fuel 2 mixtures were substantially reduced.

Further samples as described above were untreated and treated with, in addition to various concentrations of the EVA blend, various concentrations of WASA 1, and stored at −15° C. for 3 days. They were then examined for wax formation, its appearance and degree of settling if present, and the appearance of the liquid. The results are shown in Table 2, together with the CFPP's of the materials.

In all Tables, the concentration of additives is given in terms of active ingredient actually used.

TABLE 2

| Conc. EVA, ppm | Conc. WASA, ppm | RME alone | RME/FUEL 50/50 | RME/FUEL 10/90 | Fuel alone | Sample No |
|---|---|---|---|---|---|---|
| | | CFPP | CFPP | CFPP | CFPP | |
| | | WAX | WAX | WAX | WAX | |
| | | FUEL | FUEL | FUEL | FUEL | |
| 0 | 0 | −11 | −10 | −3 | −4 | 1 |
| | | 100 SOLID | NWS | 96 FLOCC | NWS | |
| | | NO LIQ. | CLOUDY | V. HAZY | CLOUDY | |
| 320 | 0 | −13 | −27 | −27 | −16 | 2 |
| | | 96 | 20 | 26 FLUFFY | 25 V. MOB | |
| | | SL. HAZY | CLOUDY | HAZY | V. HAZY | |
| 640 | 0 | −13 | −25 | −27 | −26 | 3 |
| | | 69 | 20 MOB | 54 MOB | 40 V. MOB | |
| | | SL. HAZY | V. HAZY | HAZY | V. HAZY | |
| 320 | 600 | −13 | −20 | −17 | −19 | 4 |
| | | 85 | NWS | NWS | 90 FLUFFY | |
| | | HAZY | CLOUDY | V. CLOUDY | CLEAR | |
| 640 | 600 | −15 | −21 | −18 | −21 | 5 |
| | | 90 MOB | NWS | NWS | 90 MOB | |
| | | V. HAZY | CLOUDY | V. CLOUDY | CLOUDY | |
| 640 | 1200 | −15 | −26 | −20 | −16 | 6 |
| | | 90 MOB | NWS | NWS | 45 FLUFFY | |
| | | V. HAZY | CLOUDY | CLOUDY | V. HAZY | |

Abbreviation:
NWS - No wax settlement
MOB - MobileWax material described as fluffy was also mobile
V. - Very, SL - Slightly
LIQ. - Liquid
FLOCC - Flocculated The numbers in the "WAX" rows indicate the percentage of the fuel in the vessel occupied by the wax.

The results show that the combination of EVA and WASA in fuel mixtures effectively reduces CFPP and prevents wax settlement.

EXAMPLE 2

In this example, the petroleum-based fuel was FUEL 1; the same RME was used as in Example 1.

As well as the blend of EVA 1 and EVA 2 used in Example 1, an ethylene-vinyl acetate copolymer containing 29 weight % vinyl acetate, $\overline{M}n$ about 2400, $CH_3/100CH_2$ 4 was used; this is denominated EVA 3. WASA 2 is a blend of equal parts by weight of a $C_{12}$ alkyl fumarate/vinyl acetate comb polymer and the same amide-amine salt as in WASA 1. WASA 3 is a blend of 1 part each by weight of a $C_{16}$ alkyl polyitaconate and $C_{18}$ alkyl polyitaconate and 2 parts by weight of the same amide-amine salt as in WASA 1.

The samples described in Table 3 below were tested for CFPP and for appearance after storage for 4 days at −15° C.

TABLE 3

| Sample No | | 7 | 8 | 9 | 10 |
|---|---|---|---|---|---|
| EVA 1, 2, ppm | | — | 640 | | |
| EVA 3, ppm | | — | | 600 | 500 |
| WASA 1, ppm | | — | 600 | 600 | |
| WASA 2, ppm | | — | | | 600 |
| WASA 3, ppm | | — | | | |
| RME alone | CFPP | −13 | −15 | −15 | −13 |
| 1 | WAX | SOLID | 10 | 20 | NWS |
| | FUEL | V. CLOUDY | HAZY | HAZY | CLOUDY |
| RME/FUEL 75/25 | CFPP | −11 | −17 | −14 | −16 |
| 1 | WAX | SOLID | NWS | NWS | NWS |
| | FUEL | V. CLOUDY | CLOUDY | CLOUDY | V. CLOUDY |
| RME/FUEL 10/90 | CFPP | −4 | −21 | −20 | −20 |
| 1 | WAX | NWS | NWS | NWS | NWS |
| | FUEL | CLOUDY | CLOUDY | CLOUDY | CLOUDY |
| RME/FUEL 5/95 | CFPP | −6 | −20 | −18 | −12 |
| 1 | WAX | 90 FLOCC | 65 FLOCC | 45 FLOCC | NWS |
| | FUEL | V. HAZY | V. HAZY | CLOUDY | CLOUDY |
| FUEL alone | CFPP | −6 | −20 | −19 | −11 |
| | WAX | 85 FLOCC | 40 | 25 | 2 |
| | FUEL | V. HAZY | V. HAZY | V. HAZY | CLOUDY |

| Sample No | | 11 | 12 | 13 |
|---|---|---|---|---|
| EVA 1, 2, ppm | | | | 640 |
| EVA 3, ppm | | 600 | 300 | |
| WASA 1, ppm | | | | |
| WASA 2, ppm | | 600 | | 600 |
| WASA 3, ppm | | | 600 | |
| RME alone | CFPP | −14 | −14 | −13 |
| 1 | WAX | NWS | 50 | 10 |
| | FUEL | CLOUDY | HAZY | CLOUDY |
| RME/FUEL 75/25 | CFPP | −16 | −22 | −15 |
| 1 | WAX | NWS | NWS | NWS |
| | FUEL | CLOUDY | V. CLOUDY | CLOUDY |
| RME/FUEL 10/90 | CFPP | −24 | −25 | −19 |
| 1 | WAX | 10 | NWS | NWS |
| | FUEL | CLOUDY | CLOUDY | CLOUDY |
| RME/FUEL 5/95 | CFPP | −13 | −21 | −12 |
| 1 | WAX | NWS | 53 FLOCC | 30 |
| | FUEL | V. CLOUDY | CLOUDY | V. CLOUDY |
| FUEL alone | CFPP | −12 | −13 | −12 |
| | WAX | 25 | 32 | 35 |
| | FUEL | CLOUDY | CLOUDY | V. HAZY |

The results in Table 3 show that in many cases the improvement in CFPP and reduction in wax settlement are better for the mixtures than for the individual fules.

EXAMPLE 3

In this example, Fuel 2 was used, together with the same RME as used in Example 1. The results of Examples 1 and 2 are confirmed. The results are shown in Table 4.

TABLE 4

| Sample No | | 14 | 15 | 16 | 17 | 18 |
|---|---|---|---|---|---|---|
| EVA 1, 2, ppm | | 0 | 320 | | | 640 |
| EVA 3, ppm | | 0 | | 300 | 600 | |
| WASA 1, ppm | | 0 | | | | 1200 |
| WASA 2, ppm | | 0 | | 600 | | |
| WASA 3, ppm | | 0 | | | 600 | |
| RME alone | CFPP | −13 | −13 | −13 | 14 | −15 |
| 1 | WAX | SOLID | 96 | NWS | 60 | 9 |
| | LIQUID | | HAZY | CLOUDY | HAZY | HAZY |
| RME/FUEL 75/25 | CFPP | −15 | | −16 | −12 | |
| 1 | WAX | NWS | | NWS | NWS | |
| | FUEL | | | CLOUDY | CLOUDY | |
| RME/FUEL 50/50 | CFPP | −6 | −27 | −22 | −17 | −26 |
| 1 | WAX | NWS | 20 | NWS | NWS | NWS |
| | FUEL | | CLOUDY | CLOUDY | CLOUDY | CLOUDY |
| RME/FUEL 10/90 | CFPP | −5 | −27 | −28 | −27 | −20 |
| 1 | WAX | 50 | 26 | NWS | NWS | NWS |
| | FUEL | HAZY | HAZY | CLOUDY | CLOUDY | CLOUDY |
| RME FUEL 5/95 | CFPP | −3 | | −27 | −28 | |
| 1 | WAX | 5 | | 2 | NWS | |
| | FUEL | HAZY | | CLOUDY | CLOUDY | |
| FUEL alone | CFPP | −5 | −16 | −12 | −14 | −16 |
| | WAX | NWS | 25 | 90 | 80 | 45 |
| | FUEL | | HAZY | HAZY | HAZY | HAZY |

EXAMPLE 4

In this example, the biofuel used was the same as in Example 1, and the petroleum fuel was Fuel 2.

600 ppm of a fumarate-vinyl acetate comb copolymer were mixed with pure RME, pure Fuel 2, and mixtures of RME and Fuel 2, and the CFPP's compared with those of untreated fuels. The copolymer was of a mixed $C_{12}/C_{14}$ alkyl fumarate obtained by reaction of a 1:1 weight mixture of normal $C_{12}$ and $C_{14}$ alcohols with a fumaric acid and vinyl acetate copolymer, prepared by solution polymerization. The results shown in Table 5 indicate that a comb polymer alone is surprisingly effective in reducing the CFPP of a mixture of petroleum and biofuels.

TABLE 5

| | CFPP, °C. | |
|---|---|---|
| Fuel | Untreated | Treated |
| RME alone | −11 | −10 |
| RME - 50%, Fuel 2 - 50% | −10 | −14 |
| RME - 10%, Fuel 2 - 90% | −3 | −12 |
| Fuel 2 alone | −4 | −8 |

We claim:

1. A fuel oil composition comprising a mixture of 10–50% by weight of a biofuel selected from the group consisting of vegetable oil and re-esterified vegetable oil with a petroleum based middle distillate fraction containing 0.0005% to 1% by weight of an additive being a mixture of a first ethylene vinyl acetate copolymer having 36 wt. % ethylene and an Mn of about 2400 with a second ethylene vinyl acetate copolymer having 14 wt. % vinyl acetate and a Mn of about 3500, the weight ratio of the first ethylene vinyl acetate to the second being 6:1.

2. A fuel oil composition comprising a mixture of 10–50% by weight of a biofuel selected from the group consisting of vegetable oil and re-esterified vegetable with a petroleum based middle distillate fraction containing 0.0005% to 1% by weight of an additive comprising a mixture of an oil soluble ethylene vinyl acetate and a wax antisettling agent which is a mixture of equal parts by weight of (i) a $C_{12}/C_{14}$ alkyl fumarate/vinyl acetate comb copolymer and (ii) the amide-amine salt of phthalic anhydride with two molar properties of hydrogenated tallow.

3. A fuel oil composition comprising a mixture of 10–50% by weight of a biofuel selected from the group consisting of vegetable oil and re-esterified vegetable oil with a petroleum based middle distillate fraction containing 0.0005% to 1% by weight of an additive comprising a mixture of an oil soluble ethylene vinyl acetate and a wax antisettling agent which is a blend of 1 part each by weight of a $C_{16}$ alkyl polyitaconate and $C_{18}$ alkyl polyitaconate and 2 parts by weight of the amide-amine salt of phthalic anhydride with two molar proportions of hydrogenated tallow.

* * * * *